United States Patent [19]

Sileo

[11] 3,968,963

[45] July 13, 1976

[54] CHAIR-TYPE BICYCLE EXERCISE DEVICE

[75] Inventor: Rocco M. Sileo, Stamford, Conn.

[73] Assignee: The Raymond Lee Organization, Inc., New York, N.Y. ; a part interest

[22] Filed: Jan. 27, 1975

[21] Appl. No.: 544,122

[52] U.S. Cl. ..... 272/134; 272/73
[51] Int. Cl.[2] ..... A63B 21/00
[58] Field of Search ..... 272/58, 73, 79 R

[56] References Cited

UNITED STATES PATENTS

| | | | |
|---|---|---|---|
| 3,216,722 | 11/1965 | Odom | 272/58 |
| 3,259,385 | 7/1966 | Boren | 272/73 |
| 3,622,153 | 9/1969 | Thompson | 272/73 |
| 3,738,649 | 6/1973 | Miller | 272/73 |

FOREIGN PATENTS OR APPLICATIONS

| | | | |
|---|---|---|---|
| 1,183,652 | 7/1959 | France | 272/73 |

*Primary Examiner*—Richard C. Pinkham
*Assistant Examiner*—T. Brown
*Attorney, Agent, or Firm*—Daniel Jay Tick

[57] ABSTRACT

Bicycle-type pedals are rotatably mounted on a frame in a manner whereby the pedals are rotatable by a user seated in a chair in proximity with the frame; the frame is elongated and is adjustably attached to the under surface of the seat by means of a track whereby the frame can be totally disposed under the seat when not in use and can be adjustably disposed in front of the chair when in use; the pedals are attached intermediate the ends of the frame and can be stored under the seat along with the frame; the frame is provided at one of its ends with a vertically adjustable leg for adjusting the pedals relative to a support surface.

1 Claim, 5 Drawing Figures

CHAIR-TYPE BICYCLE EXERCISE DEVICE

DESCRIPTION OF THE INVENTION:

The present invention relates to an exercise device.

Objects of the invention are to provide an exercise device of simple structure which is inexpensive in manufacture, used with facility, convenience and comfort by a seated user, and functions efficiently, effectively and reliably to provide exercise of the leg and thigh muscles of a user seated in a chair.

In order that the invention may be readily carried into effect, it will now be described with reference to the accompanying drawing, wherein.

In the FIGS., the same components are identified by the same reference numerals.

The exercise device of the invention provides exercise for the leg and thigh muscles of a seated user.

Figure 3:
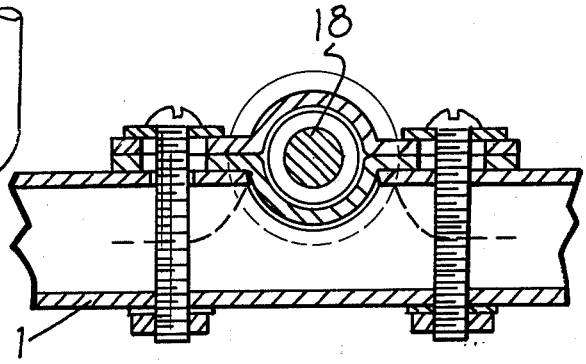
FIG. 3 is a sectional view, taken along the lines III—III, of FIG. 2.
Figure 4:
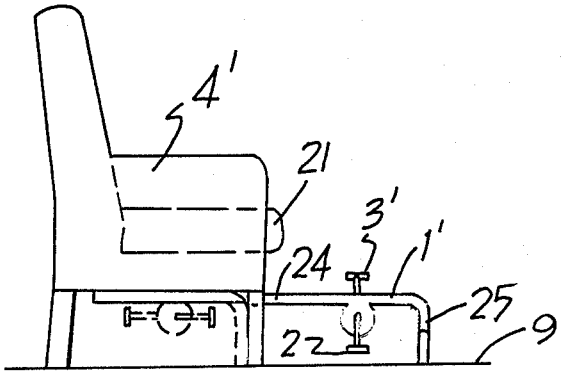
FIG. 4 is a side view of another embodiment of the exercise device of the invention.

The exercise device of the invention comprises a frame 1 (FIGS. 1 to 3) or 1′ (FIG. 4).

Bicycle-type pedals 2 and 3 (FIG. 1) or 2′ and 3′ (FIG. 4) are rotatably mounted on the frame 1 or 1′ in a manner whereby the pedals are rotatable by a user seated in a chair 4 (FIG. 1) or 4′ (FIG. 4) in proximity with the frame 1 or 1′.

Figure 1:
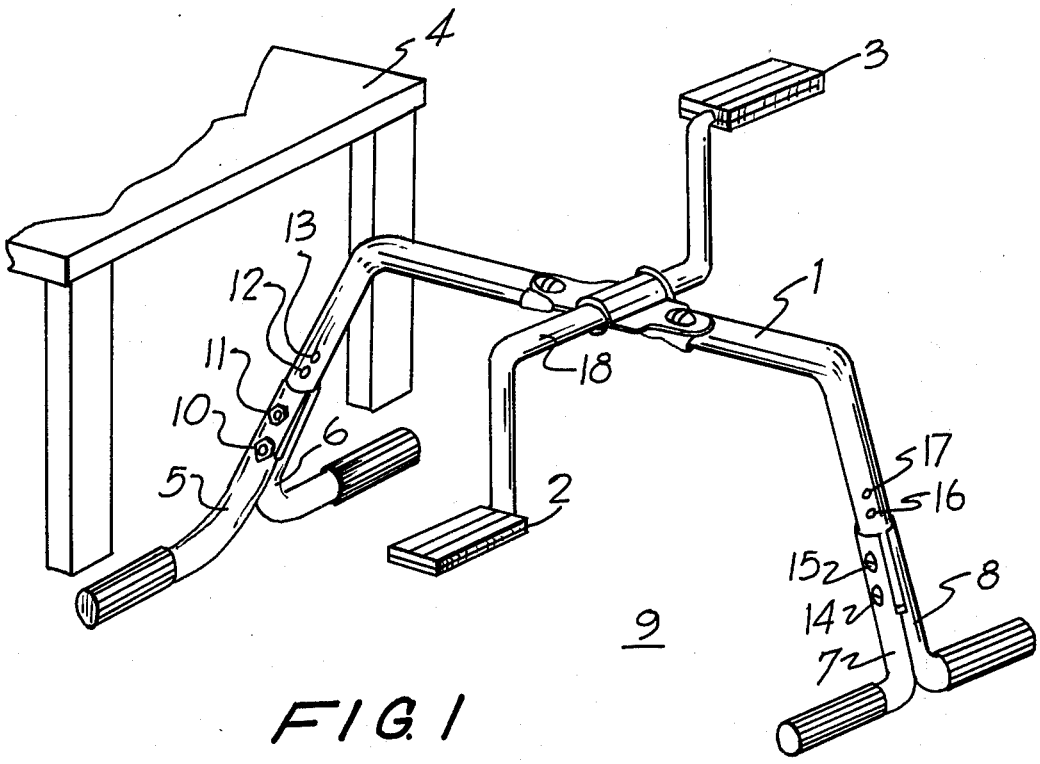
FIG. 1 is a schematic diagram of an embodiment of the exercise device of the invention.
Figure 2:
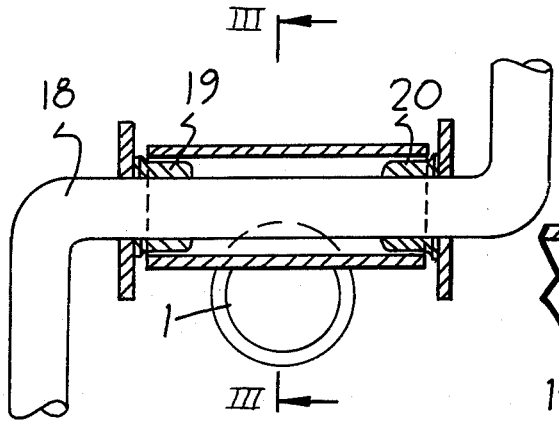
FIG. 2 is a view, partly in section, on an enlarged scale, of part of the exercise device of FIG. 1.

In the embodiment of FIGS. 1 to 3, support legs 5, 6, 7 and 8 (FIG. 1) on the frame 1 adjustably mount the frame on a supporting surface 9. The frame 1 is supported with the pedals 2 and 3 a selected distance above the surface 9. This is accomplished by passing bolts 10 and 11 through spaced holes in the legs 5 and 6 and spaced corresponding holes 12, 13, and the like, in the frame. Similarly, bolts 14 and 15 are passed through spaced holes through the legs 7 and 8 and spaced corresponding holes 16, 17, and the like, through the frame 1.

As shown in FIGS. 2 and 3, an arm 18 supporting the pedals 2 and 3 or 2′ and 3′ is rotatably mounted on the frame 1 or 1′ by split bearings 19 and 20.

Figure 5:
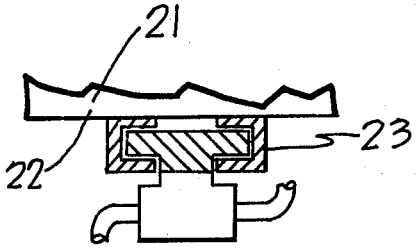
FIG. 5 is a view, partly in section, on an enlarged scale, of part of the embodiment of FIG. 4.

In the embodiment of FIGS. 4 and 5, a chair 4′ has a seat 21 having an undersurface 22 (FIG. 5). A guide device 23 (FIG. 5) is affixed to the undersurface 22 of the seat 21 of the chair 4′ and slidably accommodates and supports one end 24 of the frame 1′ for movement under and in front of the chair 4′. The other end 25 of the frame 1′ is adjustably supported on the supporting surface 9 in the same manner as is the frame 1 of the embodiment of FIGS. 1 to 3 so that the pedals 2′ and 3′ are supported a selected distance above such surface. The pedals 2′ and 3′ are thus positionable relative to the chair 4′ by a user seated in the chair and the pedals are rotatable by the user to exercise his or her legs and thighs.

While the invention has been described by means of specific examples and in specific embodiments, I do not wish to be limited thereto, for obvious modifications will occur to those skilled in the art without departing from the spirit and scope of the invention.

I claim:

1. An exercise device, comprising a frame having spaced opposite first and second ends;

a chair having a seat having an undersurface and supported a predetermined distance above a supporting surface by legs, guide means of channel configuration affixed to the undersurface of the seat of the chair for slidably accommodating and supporting said frame for movement of said first and second ends under and for movement of said second end in front of said chair;

bicycle-type pedal means rotatably mounted on the frame intermediate the first and second ends thereof in a manner whereby the pedal means is rotatable by a user seated in said seat in proximity with the frame; and adjustable support means on the second end of the frame for adjustably mounting the second end of the frame relative to said supporting surface with the pedal means a selected distance above the surface whereby the pedal means are positionable relative to the chair by a user seated in the chair and the pedal means are rotatable by the user.

* * * * *